US005915744A

United States Patent [19]

Cotsford

[11] Patent Number: 5,915,744

[45] Date of Patent: Jun. 29, 1999

[54] RAIL ANCHOR REMOVAL

[75] Inventor: Stephen G. Cotsford, Columbia, S.C.

[73] Assignee: Harsco Corporation, Camp Hill, Pa.

[21] Appl. No.: 08/826,896

[22] Filed: Apr. 9, 1997

[51] Int. Cl.[6] ..... B23P 19/00

[52] U.S. Cl. ..... 29/426.3; 29/822; 104/17.2

[58] Field of Search ..... 29/426.3, 771, 29/779, 822, 225; 104/17.2

[56] References Cited

U.S. PATENT DOCUMENTS

| | | | |
|---|---|---|---|
| 3,117,530 | 1/1964 | Miller . | |
| 3,680,486 | 8/1972 | Plasser et al. . | |
| 3,766,860 | 10/1973 | McIlrath . | |
| 3,841,221 | 10/1974 | Dieringer et al. . | |
| 4,319,392 | 3/1982 | Cutts . | |
| 4,471,526 | 9/1984 | Zaltsberg . | |
| 4,494,463 | 1/1985 | Young et al. . | |
| 4,580,501 | 4/1986 | Collins et al. | 104/1 R |
| 4,669,387 | 6/1987 | Casarini et al. . | |
| 4,726,107 | 2/1988 | Knudson . | |
| 4,890,558 | 1/1990 | Quella et al. | 104/9 |
| 4,903,611 | 2/1990 | Holley . | |
| 4,918,797 | 4/1990 | Watkins et al. . | |
| 5,003,888 | 4/1991 | Martin . | |
| 5,074,219 | 12/1991 | Theurer et al. | 104/17.2 |
| 5,146,677 | 9/1992 | Holman et al. . | |
| 5,269,225 | 12/1993 | Bosshart et al. . | |
| 5,438,931 | 8/1995 | Becker et al. | 104/17.2 |
| 5,546,864 | 8/1996 | Straub et al. | 104/17.2 |
| 5,586,502 | 12/1996 | Weber | 104/17.2 |
| 5,730,060 | 3/1998 | Straub et al. | 104/17.2 |
| 5,839,377 | 11/1998 | Brenny et al. | 104/17.2 |

FOREIGN PATENT DOCUMENTS

| | | |
|---|---|---|
| 2348014 | 9/1973 | Germany . |
| 1540868 | 2/1979 | United Kingdom . |
| 2102863 | 5/1982 | United Kingdom . |

*Primary Examiner*—David P. Bryant
*Attorney, Agent, or Firm*—Eckert Seamans Cherin & Mellott, LLC

[57] ABSTRACT

A track renewal machine and method provides removal of anchors after rails have been separated from the ties. The rails with anchors still on them are lifted from the ties and spread using a rail threader with the anchor remover attached to it.

17 Claims, 6 Drawing Sheets

RAIL ANCHOR REMOVAL

BACKGROUND OF THE INVENTION

The present invention relates to rail anchor removal. More particularly, it relates to removal of rail anchors using a track renewal machine.

The rails of a railroad track are usually secured to cross ties by spikes driven into tie plates. These tie plates block lateral movement of the rails, i.e., movement that is transverse to the rail direction. Anchors are attached to the rails to secure the rails against longitudinal movement of the rails relative to the cross ties.

When a rail is to be replaced or renovated, the spikes which secure the tie plates and rail to the ties are first removed. The rail anchors, which often are drive-on anchors, then are removed from the rails. Often the anchors are removed from the rails using manual labor. Specifically, a person swings a sledge hammer against the drive-on anchors, driving the anchors from the base of the rail. This is very physically demanding and labor intensive.

Following the removal of the anchors, a track renewal machine with tie wagons in front of it travels along the section of rails where renewal is needed. The forgoing techniques have usually required removal of the anchors in advance of the tie wagons entering that section of the track.

The track renewal machine then uses rail threaders which move the rails vertically up from the ties (more specifically from the tie plates on the ties) and spreads the rails out horizontally sufficiently far that old ties may be lifted up without hitting the rails. Various other operations are commonly performed such as inserting new ties, distributing ballast around the new ties, and applying rail clips. Either the old rails (if in acceptable condition) or new rails are then laid on the new cross ties and are secured in place. As used herein, a track renewal machine shall includes machines which spread out rails such that ties may be lifted up from in between the rails and any machines having rail threaders thereon.

It will be understood, that if only the ties are to be replaced for a given section of track and the rails are not being replaced, a tie gang may be used. With a tie gang, the cross ties are removed from beneath the side of the rails, but without spreading the rails apart. This is a different process than the rail spreading track renewal discussed hereinabove.

Devices have been developed to remove anchors automatically and without the manual labor associated with sledge hammer removal. However, such devices have increased the complexity of the already complex series of operations used in rail spreading track renewal.

The following U.S. Patents and their issue dates are noted:

U.S. Pat. No. 4,903,611 Holley Feb. 27, 1990

U.S. Pat. No. 5,146,677 Holman et al. Sep. 15, 1992

U.S. Pat. No. 5,269,225 Bosshart et al. Dec. 14, 1993

The Holley Patent shows an anchor spreader apparatus and method for using with tie gangs.

The Holman Patent discloses a rail anchor remover mounted on a crane.

The Bosshart Patent shows an apparatus and method for applying rail clips and insulators.

None of these prior art devices have been found to be completely satisfactory.

OBJECTS AND SUMMARY OF THE INVENTION

Accordingly, it is a primary object of the present invention to provide a new and improved apparatus and method for removal of rail anchors.

A more specific object of the present invention is to provide removal of anchors as part of the threading of the rails and with minimal need for additional machinery beyond the normal track renewal machinery.

A further object of the present invention is to provide anchor removal with a simplified, automatic technique.

Yet another object of the present invention is to provide anchor removal with automatic conveyance of removed anchors to an appropriate location so that they may be reused if suitable for reuse and may easily be disposed of if they are not suitable for reuse.

The above and other features of the present invention are realized by a track renewal machine having a frame, right and left rail threaders that are supported by the frame so that the right and left rail threaders are positioned and operable to spread rails such that ties can be lifted therebetween. Right and left anchor removers are respectively mounted to the right and left rail threaders. The right and left anchor removers are supported by the main frame and are positioned adjacent the right and left rail threaders, respectively.

A conveyor system is supported by the main frame and is position to receive anchors removed by the anchor removers and convey them to the side of the railroad track. More specifically, the conveyor system includes inclined right and left conveyor belts respectively positioned to receive anchors removed by the respective right and left anchor removers. The right and left conveyor belts extend lengthwise substantially parallel to the rail direction, i.e., the component of the belts' direction of movement in the horizontal plane is within 15 degrees of the rail direction. As used herein, the rail direction is the direction of the rails prior to their movement away from the ties under operation of the rail threaders. A transverse conveyer, i.e., transverse to the rail direction, such as a conveyor belt, is supported by the frame. The transverse conveyor receives anchors from upper ends of the right and left conveyor belts, carries the anchors to the side, and deposits them on the side of the railroad track.

Each of the right and left anchor removers includes an anchor removing roller forward or upstream i.e., in the direction of movement, from the corresponding one of the rail threaders. Each of the rail threaders includes a threader base and a plurality of threader rollers rotatably mounted thereto. The threader rollers all contact the base of a rail passing through the threader and the threaders are operable to thread the rails without any rollers contacting the balls of the rails. Each of the anchor removing rollers is rotatably mounted to the corresponding threader base for rotation about an inclined transverse axis.

Each of the rail threaders is mounted to a rail guidance frame supported by the main frame and extending transverse to the rail direction.

An alternate embodiment includes an anchor collecting bin supported by the main frame and a conveyor system supported by the main frame and positioned to receive anchors removed by the anchor removers and convey them to the anchor collecting bin.

The present invention may alternately be described as a method for track renewal including moving a track renewal machine along a section of railroad track, the track renewal machine having a front and lifting rails by having them thread through right and left rail threaders on the track renewal machine. Anchors are removed from the rails by use of right and left anchor removers on the track renewal machine. The right and left anchor removers are disposed upstream respectively of the right and left rail threaders such that anchors on the rails are removed between the front of the track renewal machine and the right and left rail threaders.

The method also includes the steps of: supplying anchors as they are removed from the rails to a conveyor system; and conveying the caught anchors using the conveyor system to a side of a railroad track. The removal of the anchors by the right and left anchor removers is accomplished by anchor removing rollers supported by a base on the respective right and left rail threaders. The threading of the rails is performed by right and left rail threaders having a plurality of threader rollers rotatably mounted to the base of the corresponding right and left threaders. The threader rollers all contact the base of a rail passing through the threader and the threaders thread the rails without any rollers contacting the balls of the rails. The right and left rail threaders stabilize rail positions such that the anchor removing rollers of the right and left anchor removers can push the anchors for removal thereof without the anchor removing rollers moving the rails.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
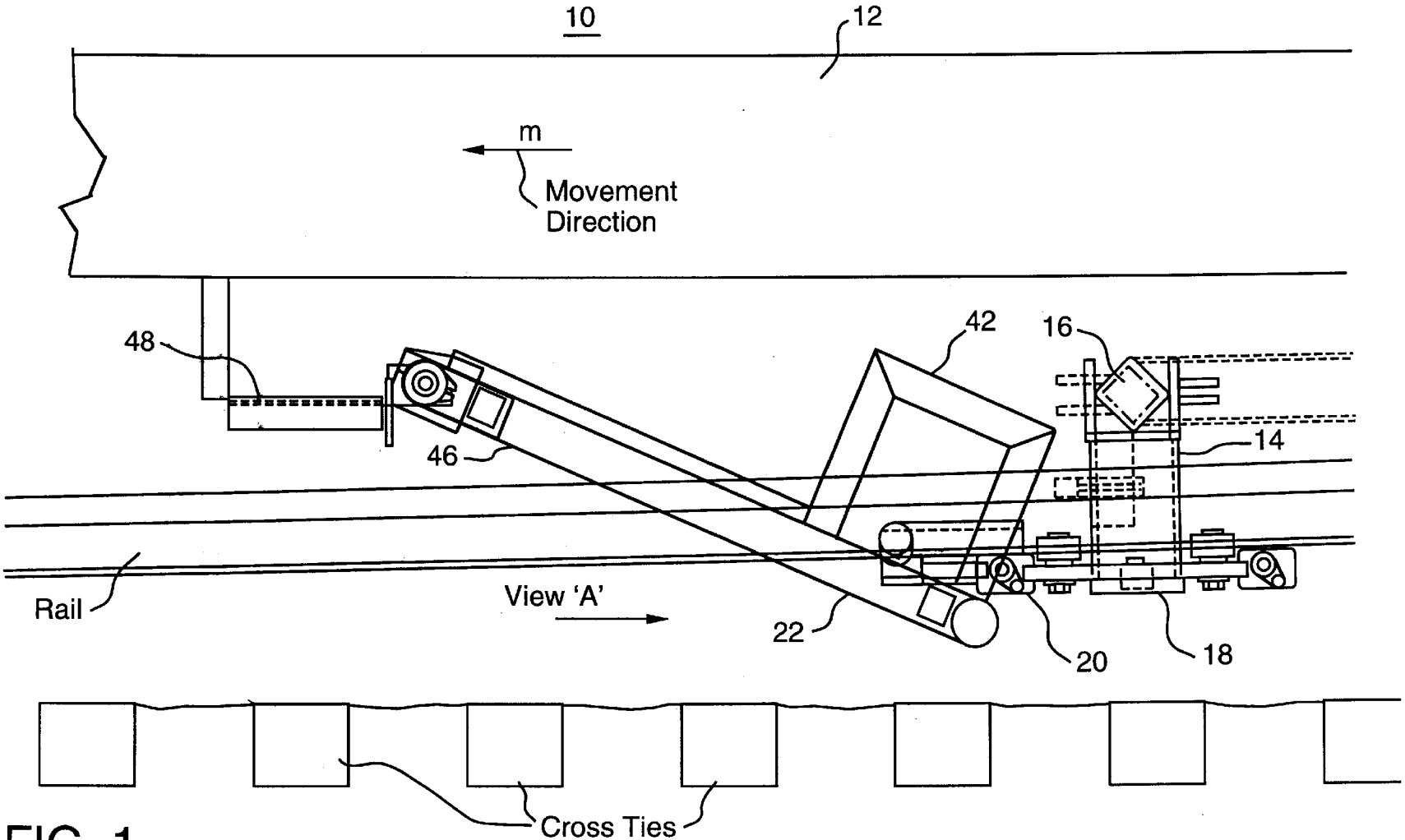
FIG. 1 is a simplified side view of the anchor remover according to the present invention and with only some related portions of a track renewal machine shown.

With reference now to FIG. 1, a track renewal machine 10 according to the present invention is partially shown. The machine 10 has a frame 12. Since track renewal machines are generally well known, the present description will concentrate on differences between the present track renewal machine and previously known track renewal machines. Thus, little or no description of features common to prior track renewal machines will be presented herein.

Initially, the relationship and operation of the primary components will be discussed. Various details of the construction of some of the primary components will then be discussed as appropriate.

A rail guidance system 14 includes a rail guidance frame 16 (extending transverse to the lengthwise direction of the rails) and right and left rail threaders 18 (only one visible in FIG. 1). The present invention is essentially symmetric about a central axis extending in the rail direction (i.e., direction of the rails prior to their threading). Therefore, it will be readily understood that structures on the right and left sides are identical in construction and operation such that the description of one side will suffice to understand the other side. The rail guidance system 14 is a known structure and operates in known fashion with right and left rail threaders 18 lifting and separating the respective right and left rails.

Unlike known rail guidance systems, rail guidance system 14 has right and left anchor removers 20 adjacent and mounted to the corresponding respective right and left rail threaders 18. The anchor removers 20 are supported by the frame 12 by way of rail guidance frame 16 since frame 16 is mounted to frame 12 in known fashion. As machine 10 travels leftwardly in the view of FIG. 1, the anchor removers 20 remove anchors just before the rails go through the corresponding one of rail threaders 18. The anchors which are removed (not separately shown in FIG. 1) are supplied to a conveyor system 22 for carrying such anchors to the side of the machine 10.

Figure 2:
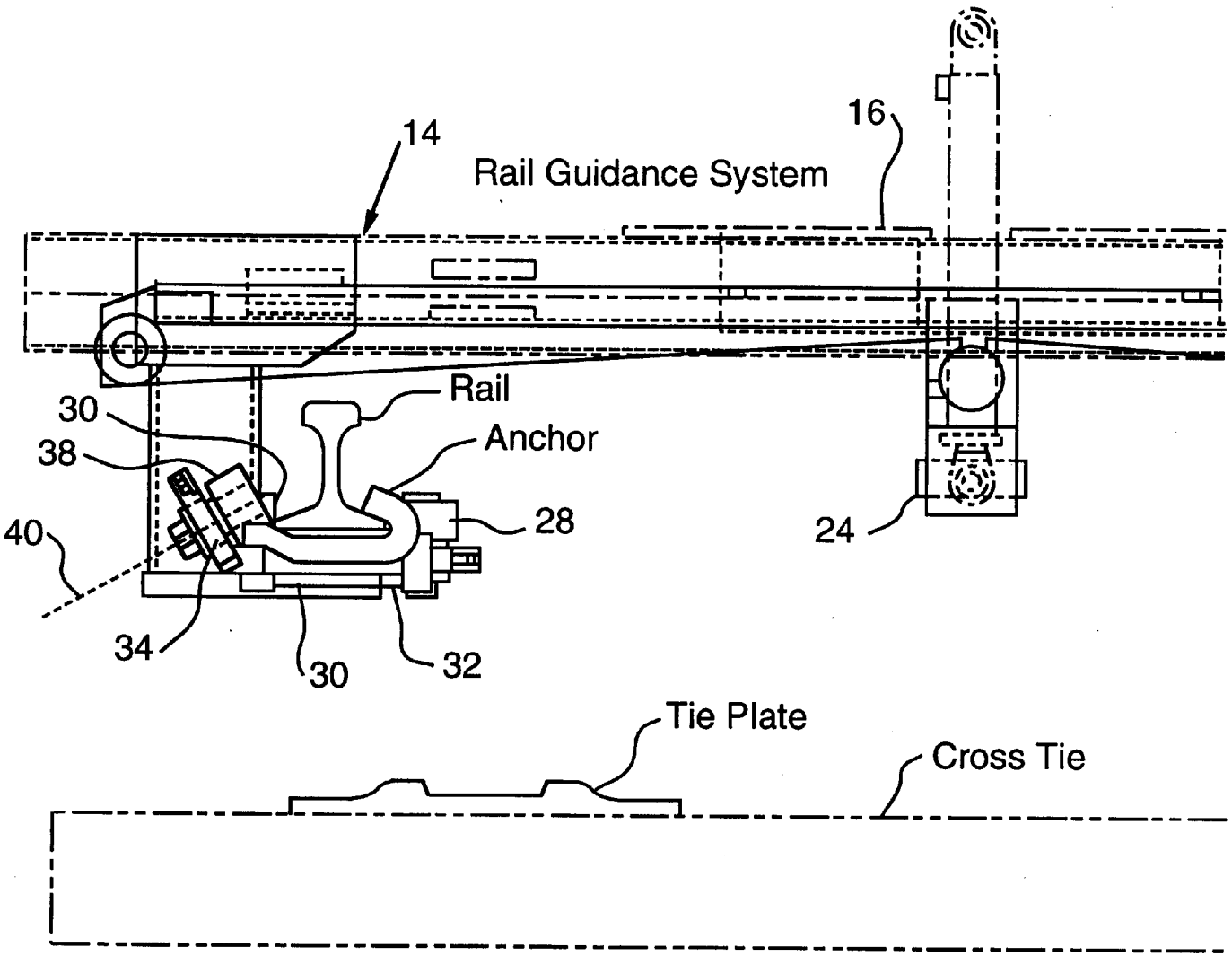
FIG. 2 is a front view of the anchor remover according to the present invention and with only portions of a track renewal machine shown.

Continuing to view FIG. 1, but also considering FIGS. 2–4, the various components will be discussed in more detail. A crawler mount 24 (FIGS. 2 and 4) is shown attached to a rail guidance system 14 for mounting a crawler (not shown) in known fashion. Each of the right and left rail threaders 18 includes a set of four upright threader rollers 28 (front field side, front gauge side, back field side, and back gauge side) which rotate about preferably vertical axes or at least substantially vertical axes, e.g., within 15 degrees of vertical. Each set of four upright rollers 28 cooperate with two horizontal rollers 30 which rotate about preferably horizontal axes or at least substantially horizontal axes, e.g., within 15 degrees of horizontal. The rollers 28 and 30, which are mounted on threader base plate 32, operate in known fashion to thread rails. The rails are threaded, as best shown in FIG. 2, by rollers 28 and 30 capturing the base or flange of the rails and without any of the rollers contacting the ball or upper part of the rails.

Figure 3:
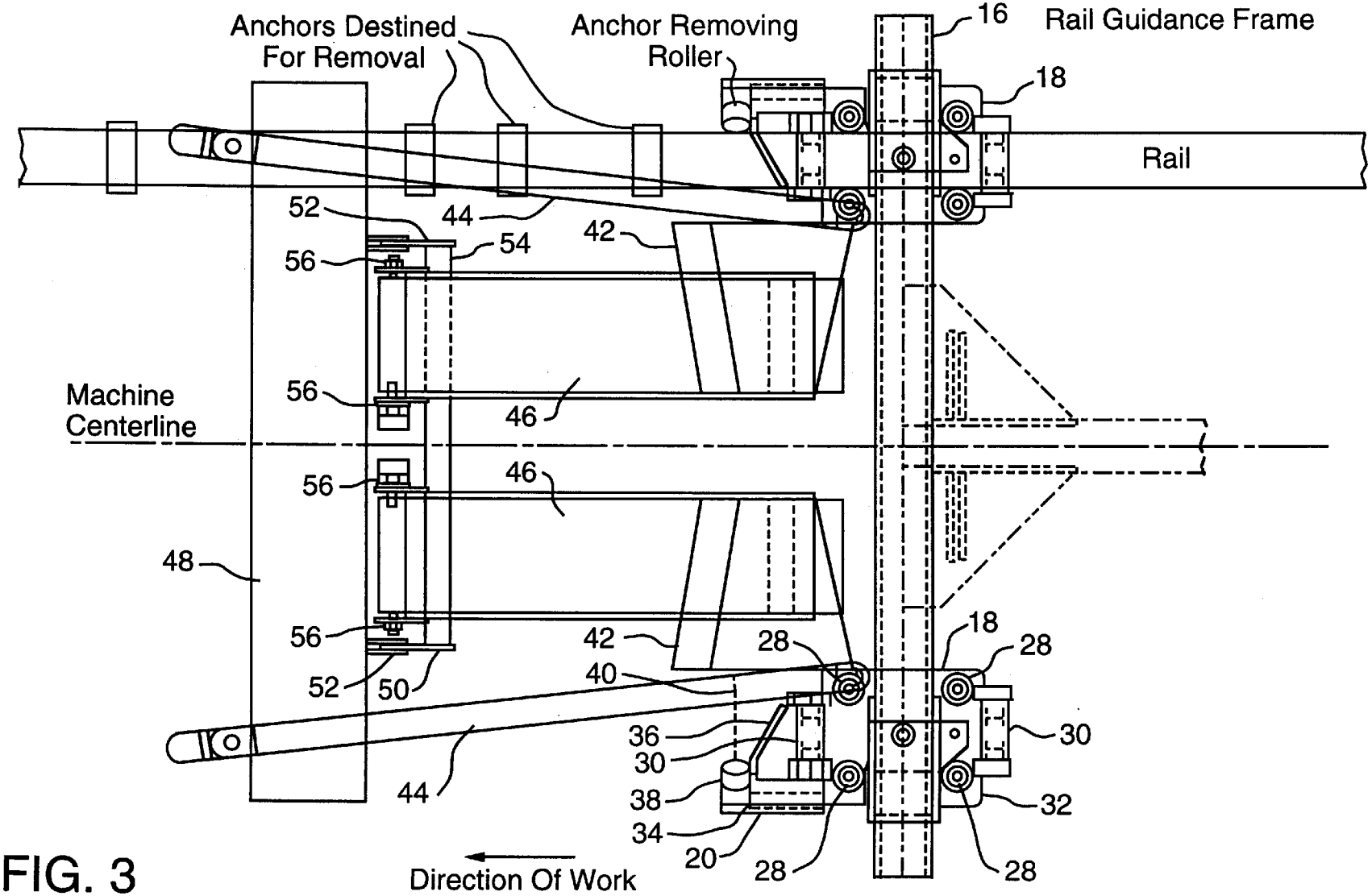
FIG. 3 is an enlarged top view of a conveyor arrangement and right and left anchor removers mounted to corresponding right and left rail threaders.

Referring to FIG. 3, base 32 of each of the threaders 18 has mounted to it an anchor remover 20 including a support member 34 and cross support 36, both of which are welded or otherwise fixed to base 32. Anchor removal roller 38 is rotatably mounted to support member 34 for rotation about axis 40 (FIG. 2). Axis 40 extends transversely to the rail direction as shown in FIG. 3, and is inclined as shown in FIG. 2. The angle of inclination of axis 40 is preferably in a range between approximately 30 and 60 degrees relative to horizontal, more preferably in a range between approximately 40 and 50 degrees. Most preferably, the angle of inclination is about 45 degrees.

As the anchors hit the anchor removal roller 38 (see FIGS. 2 and 3), the threader rollers 28 and 30 stabilize the rail relative to anchor removal roller 38 such that anchor removal roller 38 causes anchors to pop off of the rail just before the portion of the rail on which the anchor is disposed goes through rail guidance system 14.

Figure 4:
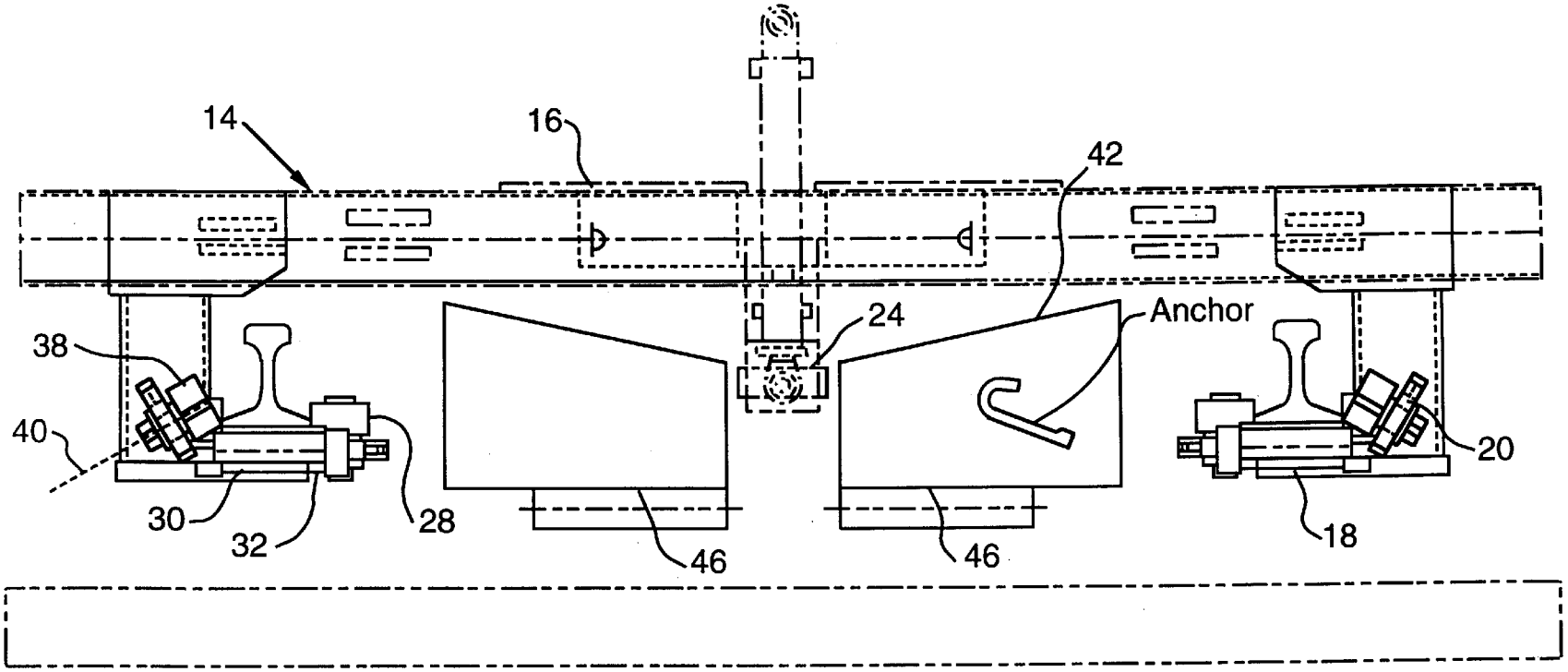
FIG. 4 is a front view showing right and left side anchor removers and some related components.

Referring now to FIGS. 1, 3 and 4, a funnel-like anchor catch or chute 42 is disposed adjacent to each of the right and left anchor removers 20. Each catch 42 deflects removed anchors onto the lower end of either right or left inclined conveyor belts 46. Conveyor belts 46 comprise an upper end disposed adjacent to a transverse conveyor belt 48. Each conveyor belt 46 carries the loose anchors to its upper end, where the anchors drop off onto transverse conveyor belt 48. Transverse (horizontal) conveyor belt 48 carries the loose anchors to either the right or left side of machine 10. As shown in FIG. 3, the upper ends of inclined conveyors 46 may be rotatably mounted by way of support 50 having right and left plates 52, transverse rod 54, and plates 56 mounted thereto. By having the upper ends of conveyors 46 rotatably supported by frame 12, conveyors 46 can be moved between the working position illustrated and a storage position (not shown) wherein the lower ends can be lifted up by either a hydraulic cylinder (not shown) or manually. In the storage position, the conveyors may be pinned or otherwise secured.

Figure 5:
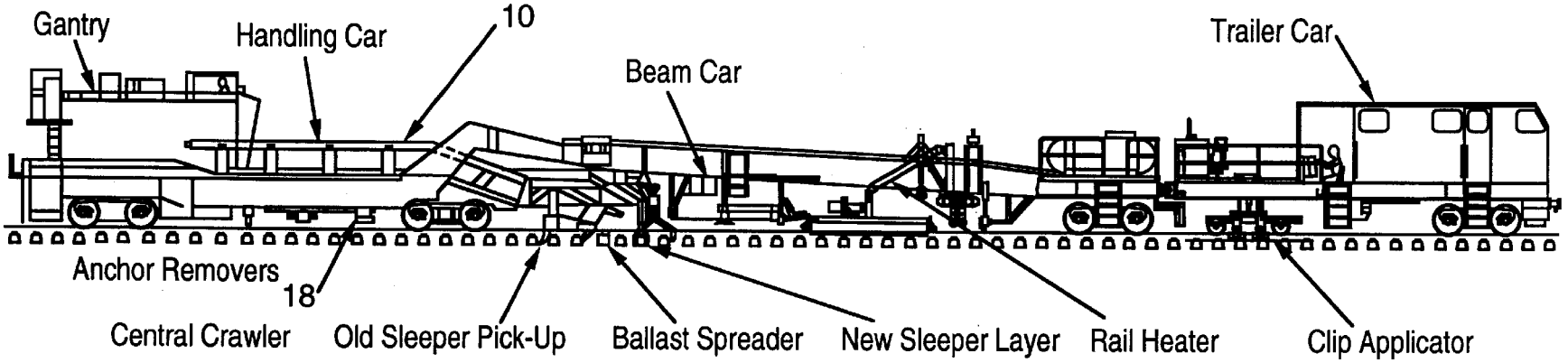
FIG. 5 is a side view of the overall track renewal machine according to the present invention.

With reference now of FIG. 5, the track renewal machine 10 with anchor removers 20 is shown together with other mechanisms used in track renewal including a gantry, handling car, beam car and trailer car. The more specific mechanisms shown also include a central crawler (which would attach to mount 24 of FIG. 2), old sleeper or cross tie pickup, ballast spreader, new sleeper or cross tie layer, rail heater, and clip applicator. None of the details of these specific mechanisms need be described herein, but it is noted that the rail heater and clip applicator are described in a co-pending application entitled RAIL HEATING AND CLIP APPLICATOR, invented by the inventor herein, assigned to the assignee of the present application, filed Apr. 14, 1997, Ser. No. 08/839,460, and hereby incorporated herein by reference.

Figure 6:
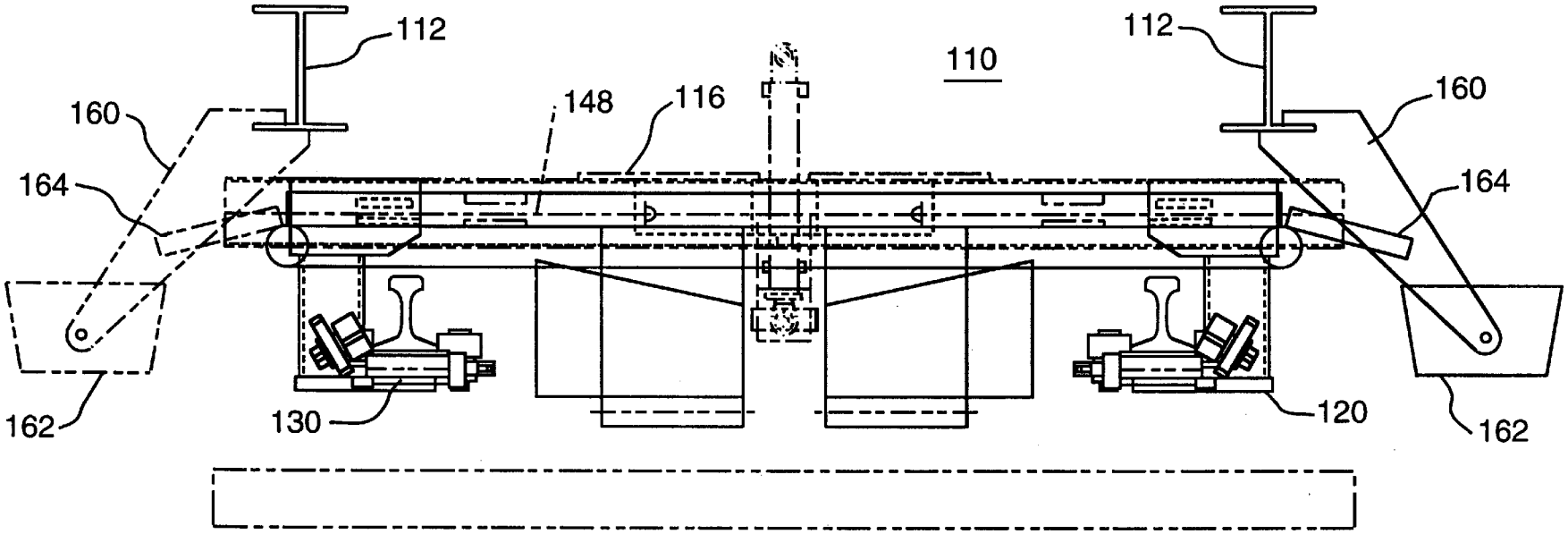
FIG. 6 is a front view of an alternate preferred embodiment having collecting bins.

FIG. 6 shows an alternate embodiment machine 110 having components in the 100 series with the same last two digits as the corresponding component(s), if any, of the embodiment of FIGS. 1–4. Thus, components 112, 116, 120, 130, and 148 are identical in operation and construction as components 12, 16, 20, 30, and 48. Indeed, machine 110 functions and is constructed the same as machine 10 except as noted hereinbelow. Instead of transverse conveyor 148 depositing the loose anchors at the side of the road bed, support plates 160 have collecting bins 162 mounted thereto. Collecting bins 162 catch anchors that come off transverse conveyor 148 by way of one of the feeder guide plates 164.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A railroad track renewal machine comprising:

a frame;

right and left rail threaders supported by the frame, the right and left rail threaders positioned and operable to move along rails such that ties can be lifted therebetween;

right and left anchor removers respectively mounted to the right and left rail threaders; and a conveyor system supported by the frame and positioned to receive loose anchors removed by the anchor removers and convey them to a side of the railroad track.

2. The track renewal machine of claim 1 wherein the conveyor system includes inclined right and left conveyor belts respectively positioned to receive loose anchors removed by the respective right and left anchor removers.

3. The track renewal machine of claim 2 wherein the right and left conveyor belts extend lengthwise substantially parallel to the rail direction.

4. The track renewal machine of claim 3 wherein the conveyor system further includes a transverse conveyor supported by the frame, the transverse conveyor being positioned and operable to receive loose anchors from upper ends of the right and left conveyor belts, carry the loose anchors to a side of the frame, and deposit the loose anchors on a side of the railroad track.

5. The track renewal machine of claim 1 wherein each of the rail threaders includes a threader base and a plurality of threader rollers rotatably mounted thereto, and wherein each of the right and left anchor removers are supported by the frame, and wherein each of the right and left anchor removers includes an anchor removing roller disposed forwardly of a corresponding one of the rail threaders, and each of the anchor removing rollers being rotatably mounted to the corresponding threader base for rotation about an inclined transverse axis.

6. The track renewal machine of claim 5 wherein the threader rollers all contact the base of a rail passing through the threader and the threaders are operable to thread the rails without any rollers contacting the balls of the rails.

7. The track renewal machine of claim 1 wherein each of the rail threaders is mounted to a rail guidance frame supported by the frame and extending transverse to the rail direction.

8. A railroad track renewal machine comprising:

a frame;

right and left rail threaders supported by the frame, the right and left rail threaders positioned and operable to move along rails such that ties can be lifted therebetween;

right and left anchor removers respectively mounted to the right and left rail threaders; and an anchor collecting bin supported by the frame and a conveyor system supported by the frame and positioned to receive loose anchors removed by the anchor removers and convey them to the anchor collecting bin.

9. A track renewal machine comprising:

a frame;

right and left rail threaders supported by the frame, the right and left rail threaders positioned and operable to move along rails;

right and left anchor removers supported by the frame and respectively positioned adjacent the right and left rail threaders; and a conveyor system supported by the frame and positioned to receive loose anchors removed by the anchor removers and convey them to a side of the railroad track.

10. The track renewal machine of claim 9 wherein each of the rail threaders includes a threader base and a plurality of threader rollers rotatably mounted thereto, and wherein each of the right and left anchor removers are supported by the frame.

11. The track renewal machine of claim 7 wherein each of the right and left anchor removers includes an anchor removing roller disposed forwardly of a corresponding one of the rail threaders, and each of the anchor removing rollers being rotatably mounted to the corresponding threader base for rotation about an inclined transverse axis, and wherein the threader rollers all contact the base of a rail passing through the threader and the threaders are operable to thread the rails without any rollers contacting the balls of the rails.

12. The track renewal machine of claim 9 wherein each of the rail threaders is mounted to a rail guidance frame supported by the frame and extending transverse to the rail direction.

13. A method for track renewal comprising:

moving a track renewal machine along a section of railroad track, the track renewal machine having a front;

lifting rails by having them thread through right and left rail threaders on the track renewal machine;

removing anchors from the rails by use of right and left anchor removers on the track renewal machine, the right and left anchor removers being disposed upstream respectively of the right and left rail threaders such that anchors on the rails are removed between the front of the track renewal machine and the right and left rail threaders;

supplying anchors as they are removed from the rails to a conveyor system; and conveying the caught anchors using the conveyor system to a side of a railroad track.

14. The method for track renewal of claim 13 wherein the removal of the anchors by the right and left anchor removers is accomplished by anchor removing rollers supported by a base on the respective right and left rail threaders.

15. The method for track renewal of claim 13 wherein the threading of the rails is performed by right and left rail threaders having a plurality of threader rollers rotatably mounted to the base of the corresponding right and left threaders, and wherein the threader rollers all contact the base of a rail passing through the threader and the threaders thread the rails without any rollers contacting the balls of the rails.

16. The method for track renewal of claim 15 wherein the right and left rail threaders stabilize rail positions such that the anchor removing rollers of the right and left anchor removers can push the anchors for removal thereof without the anchor removing rollers moving the rails.

17. The method for track renewal of claim 15 further comprising the steps of: spreading the rails with the right and left rail threaders and lifting old ties between the rails after the rails have been spread.

* * * * *